US007497197B2

(12) United States Patent
Rodenbeck et al.

(10) Patent No.: US 7,497,197 B2
(45) Date of Patent: Mar. 3, 2009

(54) MOTOR-OPERATED TOOL

(75) Inventors: Jan Rodenbeck, Bornhoved (DE); Johannes Lügger, Hamburg (DE); Sascha Kolossow, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/843,264

(22) Filed: Aug. 22, 2007

(65) Prior Publication Data

US 2008/0105241 A1 May 8, 2008

(30) Foreign Application Priority Data

Aug. 30, 2006 (DE) ..... 20 2006 013 281 U

(51) Int. Cl.
*F01M 1/02* (2006.01)

(52) U.S. Cl. ..... 123/196 R; 184/6.8

(58) Field of Classification Search ..... 123/196 R; 184/6.8

See application file for complete search history.

(56) References Cited

FOREIGN PATENT DOCUMENTS

| | | | |
|---|---|---|---|
| DE | 826 664 | | 1/1952 |
| DE | 2 306 662 | | 8/1974 |
| DE | 198 60 391 | A1 | 6/2000 |
| DE | 100 45 311 | A1 | 3/2002 |
| DE | 202 09 794 | U1 | 11/2003 |
| DE | 102 52 474 | A1 | 6/2004 |
| JP | 59103913 | * | 6/1984 |
| JP | 06-1 46 837 | A | 5/1994 |

* cited by examiner

*Primary Examiner*—Noah Kamen
(74) *Attorney, Agent, or Firm*—Kelly Lowry & Kelley LLP

(57) ABSTRACT

A chainsaw includes an internal combustion engine with a fuel-air mixture inlet and a carburettor with a fuel-air mixture outlet disposed in the direction of flow of a fuel-air mixture in front of the fuel-air mixture inlet. A fuel-air mixture channel is provided between the fuel-air mixture outlet and the fuel-air mixture inlet. A lubricant guide is provided along components to be lubricated, such that the lubricant circuit is connected particularly effectively to the fuel supply of the internal combustion engine. A removal device for fuel with a recess which receives fuel and supplies the lubricant guide is provided between the fuel-air mixture outlet and the fuel-air mixture inlet.

24 Claims, 2 Drawing Sheets

MOTOR-OPERATED TOOL

TECHNICAL FIELD

The invention relates to a drive device for a tool, in particular for a chainsaw, comprising an internal combustion engine with a fuel-air mixture inlet and a carburettor with a fuel-air mixture outlet disposed in the direction of flow of a fuel-air mixture in front of the fuel-air mixture inlet, and a fuel-air mixture channel provided between the fuel-air mixture outlet and the fuel-air mixture inlet and a lubricant guide along components to be lubricated.

PRIOR ART

Drive devices for tools, in particular hand-guided tools such as chainsaws, angle grinders etc. are known to comprise internal combustion engines. The internal combustion engines can be configured as four- or two-stroke. The internal combustion engine is usually driven by a fuel-air mixture produced in a carburettor with the required mixing ratio. In principle, the components of the drive device must be lubricated regardless of the supply with fuel.

The separation of fuel supply and lubricant circuit is disadvantageous.

DESCRIPTION OF THE INVENTION: OBJECT, SOLUTION, ADVANTAGES

It is the object of the invention to connect the lubricant circuit particularly effectively to the fuel supply of the internal combustion engine.

The object is achieved by a drive device having the features of the main claim.

The drive device comprises an internal combustion engine with a fuel-air mixture inlet and a carburettor with a fuel-air mixture outlet disposed in the direction of flow of a fuel-air mixture in front of the fuel-air mixture inlet, and a fuel-air mixture channel provided between the fuel-air mixture outlet and the fuel-air mixture inlet. A lubricant guide is also provided along components to be lubricated. Provided according to the invention between the fuel-air mixture outlet of the carburettor and the fuel-air mixture inlet of the cylinder of the internal combustion engine is a removal device for fuel with a recess which receives fuel and supplies the lubricant guide.

The removal device is preferably configured as a suction flange between the fuel-air mixture outlet of the carburettor and the fuel-air mixture inlet of the internal combustion engine. The hitherto usual direct connection between the internal combustion engine and the carburettor via a fuel-air mixture channel is only insignificantly modified in that a narrow suction flange is interposed.

The width of the suction flange preferably comprises a minimum thickness defined by an inside diameter of the lubricant hose of the lubricant guide plus twice its wall thickness and optionally a spread angle of the end of the lubricant hose. The flange is preferably broader than its minimum thickness.

By connecting the lubricant circuit to the fuel supply of the internal combustion engine, a completely separate lubricant circuit with separate lubricant tank can be dispensed with.

The suction flange preferably interconnects the fuel-air mixture outlet and an end of the fuel-air mixture channel remote from the internal combustion engine. The suction flange can have a channel portion inner wall in alignment with an inner wall of the fuel-air mixture channel. The fuel-air mixture channel is thus lengthened by the flange width. The matching of the neighbouring components therefore only needs to be slightly modified.

For removal of the fuel used as lubricant, the suction flange at best provides the recess in the channel portion inner wall and has an opening to a connection to the lubricant guide.

The carburettor usually comprises an injection nozzle. Fuel can be removed particularly well from the channel portion inner wall when the recess therein is provided in alignment with the injection nozzle. The alignment is determined by the direction of flow of the fuel-air mixture in the fuel-air mixture channel, i.e. the recess is preferably provided along the flow lines downstream of the injection nozzle.

The recess is preferably formed so that it tapers outwards from an opening extending along an inner circumference of the channel portion inner wall. It is also feasible that the recess tapers in a tetrahedral shape in a cross-section parallel to the normal of the channel portion inner wall or is formed in a crescent shape in a cross-section parallel to the normal of the channel portion inner wall.

In order to ensure particularly good removal of fuel, the opening extends along the circumference of the channel portion inner wall and symmetrical to the alignment of the injection nozzle. For removal of an optimum quantity of lubricant, the opening can extend along an angle of at least 20°, preferably about 30°, along the inner circumference of the channel portion inner wall.

In a particularly preferred embodiment of the invention, the removal device has cooling fins on the outside. In particular, immediately after switching off the drive device, the internal combustion engine heats up because the cool fuel-air supply is suddenly interrupted and the heat removal by the exhaust gases is also absent. The additional heat formed is at least partially removed via the fuel-air mixture channel. In order that the carburettor is not heated so that it is damaged, the cooling fins additionally remove heat. For this purpose the removal device is preferably formed of heat-conducting material, at best completely of aluminium.

The drive device comprises internal combustion engines, both in the form of two-stroke engines and four-stroke engines. In principle, other internal combustion engines are also feasible as part of the drive device. The drive device is particularly suitable for driving hand-guided tools, in particular angle grinders, hedge trimmers, motor-driven chainsaws.

BRIEF DESCRIPTION OF THE DRAWINGS

The invention is described with reference to an exemplary embodiment in two figures. Shown purely schematic in the figures.

BEST MODE FOR CARRYING OUT THE INVENTION

Figure 1:
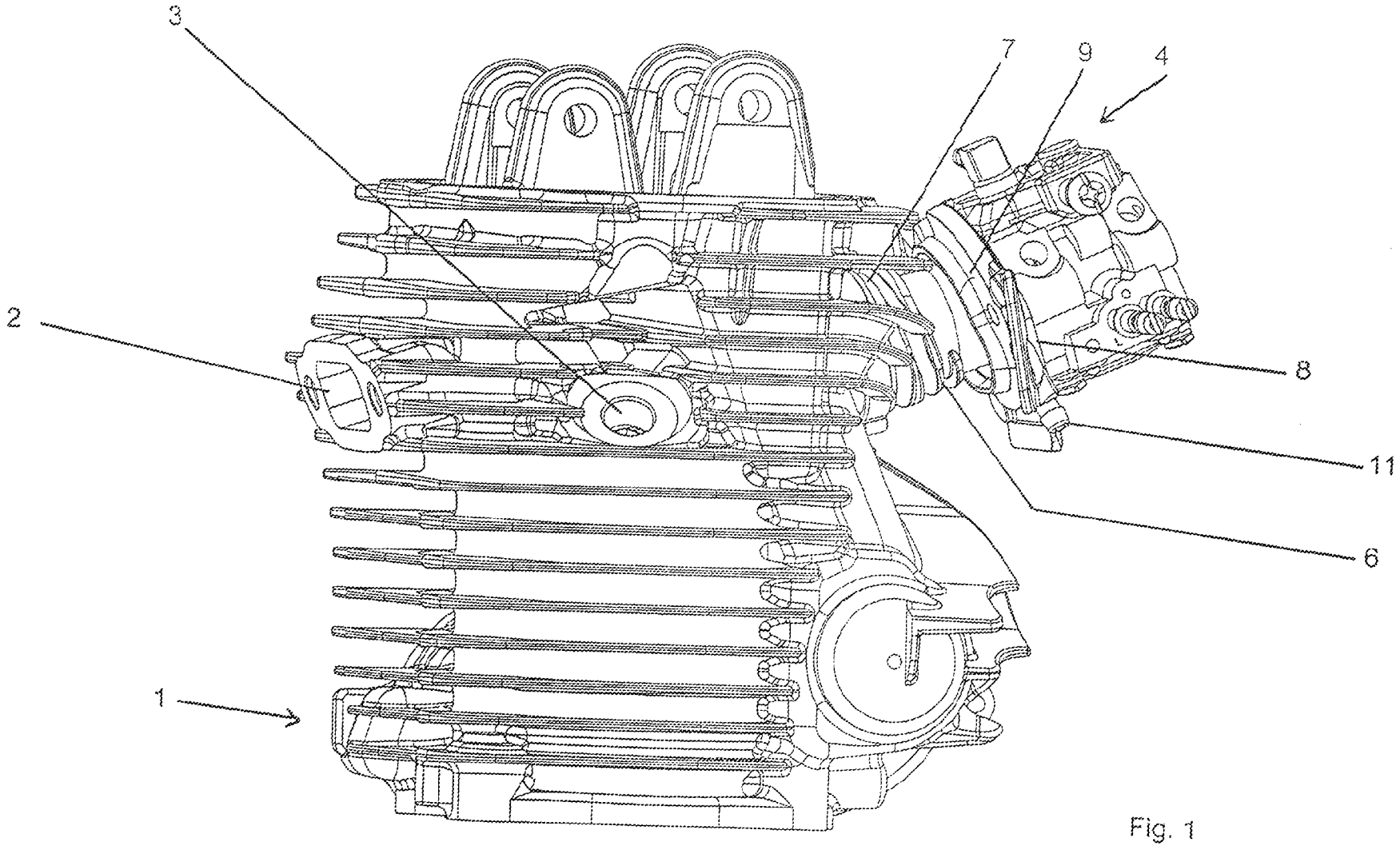
FIG. 1 is a perspective view of a four-stroke internal combustion engine with carburettor and suction flange according to the invention and FIG. 2 is a perspective view of the suction flange according to the invention.

FIG. 1 shows a four-stroke internal combustion engine 1 with an exhaust outlet 2 and a tapped hole 3 for the spark plug (not shown). Provided in FIG. 1 is a carburettor 4 disposed on the internal combustion engine 1 which provides a fuel-air mixture in a controllable mixing ratio. The carburettor 4 is gas-conductively connected to a fuel-air mixture outlet 8 among other things via a fuel-air mixture channel 6 with a fuel-air mixture inlet 7 of the internal combustion engine 1.

The fuel-air mixture outlet 8 and an end of the fuel-air mixture channel 6 remote from the internal combustion engine 1 are flange-connected to one another by the suction flange 9 according to the invention. The suction flange 9 has a lubricant outlet in the form of a hose connection 11 on the outside.

A small portion of a fuel-air mixture is removed with the aid of the suction flange 9 from the fresh charge flowing from the carburettor 4 to the internal combustion engine 1. This comprises about 3% of the fuel-air mixture flowing from the carburettor 4 to the internal combustion engine 1. The small portion of the fuel-air mixture removed is subsequently used as lubricant and introduced into the lubricant guide for this purpose.

Lubricant passes from the suction flange 9 via the hose connecting piece 11 into a hose connection (not shown) in which a first check valve is provided and from there into the crank housing of the four-stroke engine. Excited by the under- and overpressure generated by the piston stroke, it is conveyed via a separate line into the cylinder head. A second check valve is provided in the separate line, ensuring a unique direction of flow. In the cylinder head, the lubricant lubricates the valve flaps amongst other things. However, it is not mixed there with the fuel-air mixture of the combustion chamber. From the cylinder head the lubricant is conveyed via a further line into the control chamber with a camshaft. From the camshaft the lubricant flows back in a pressureless manner into an intake manifold. The intake manifold is provided in the flow direction in front of the carburettor 4. The lubricant is drawn by the air flow in the intake manifold in the carburettor 4. The lubricant is supplied via the carburettor 4 to the combustion chamber of the motor where it is burned. Most of the lubricant sucked by the suction flange 9 therefore runs through an open lubricant loop.

Figure 2:
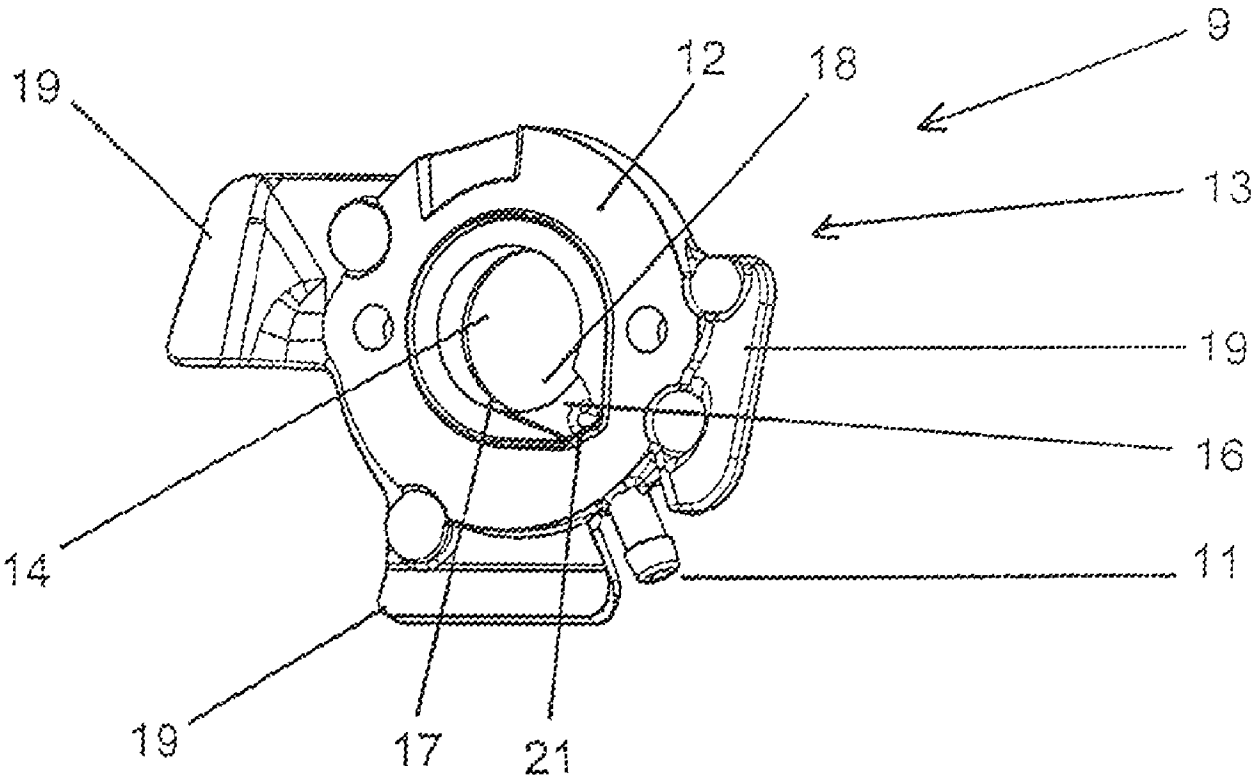

FIG. 2 shows a perspective detailed view of the suction flange 9 inserted between the carburettor 4 and the internal combustion engine 1. The side 13 facing away in FIG. 2 is connected in a gastight manner to the fuel-air mixture outlet 8 of the carburettor 4. The front side 12 of the suction flange 9 in FIG. 2 is connected in a gastight manner to the fuel-air mixture inlet 7 of the internal combustion engine 1. A fuel-air mixture connection between the carburettor 4 and the internal combustion engine 1 is thus formed in sections by the inner circular hole 14 of the suction flange 9 in a cross-section perpendicular to the longitudinal direction of the fuel-air mixture channel 6. The circular hole 14 forms a channel portion inner wall 17.

From the channel portion inner wall 17, a recess 16 is formed in the wall of the suction flange 9 in the bottom area. The recess 16 is guided into the flange wall such that it tapers slightly. Along the channel portion inner wall 17, the recess 16 has an elongated opening 18 extending about 30° along the circumference of the channel portion inner wall 17 adjacent to the hose connecting piece 11. In principle, the hose connecting piece 11 can be formed at any position externally on the suction flange 9 provided that it does not collide with other components when mounted.

The carburettor 4 has an injection nozzle (not shown). Air flows away over this in a direction of flow and sucks fuel from said nozzle. The recess 16 provided with the opening 18 is arranged in an alignment with the injection nozzle defined by the flow of the fuel-air mixture in the fuel-air mixture channel 6 in the mounted state shown in FIG. 1. In the embodiment shown the injection nozzle is provided so that it is offset somewhat laterally from the point nearest the base in the fuel-air mixture channel 6.

The recess 16 has a circular lateral opening 21 in a lateral recess wall oriented perpendicular to the channel portion inner wall 17. The circular lateral opening 21 is connected to the opening which opens into the hose connecting piece 11. The cross-sectional area of the circular lateral opening 18 is arranged parallel to the circular cross-sectional area of the hole 14.

The suction flange 9 has three externally projection cooling fins 19. The cooling fins 19 remove heat coming from the internal combustion engine 1. A particularly large amount of heat is removed from the cylinder of the combustion engine 1 directly after switching off the combustion engine 1. The heat located in the walls of the cylinder can then no longer be removed by the exhaust gases as during operation. In addition, the cooling effect from the incoming fresh charge is absent.

The suction flange 9 can be an injection moulded part.

The invention claimed is:

1. A drive device for a tool, comprising:

an internal combustion engine having a fuel-air mixture inlet and a carburettor with a fuel-air mixture outlet disposed in the direction of flow of a fuel-air mixture in front of the fuel-air mixture inlet;

a fuel-air mixture channel provided between the fuel-air mixture outlet and the fuel-air mixture inlet;

a lubricant guide along components to be lubricated; and a removal device for fuel with a recess which receives fuel and supplies the lubricant guide provided between the fuel-air mixture outlet and the fuel-air mixture inlet, characterised in that the removal device comprises a suction flange between a fuel-air mixture outlet and a fuel-air mixture inlet.

2. The drive device according to claim 1, characterised in that the removal device interconnects the fuel-air mixture outlet and an end of the fuel-air mixture channel remote from the internal combustion engine.

3. The drive device according to claim 1, characterised in that the removal device comprises a channel portion inner wall in alignment with an inner wall of the fuel-air mixture channel.

4. The drive device according to claim 3, characterised in that the recess is provided in the channel portion inner wall and comprises an opening to a connection to the lubricant guide.

5. The drive device according to claim 4, characterised in that the connection comprises a hose connection for a lubricant hose.

6. The drive device according to claim 5, characterised in that the suction flange at least has a thickness in the direction of the fuel-air mixing channel which corresponds to the inside diameter plus twice the wall thickness plus a spread of the lubricant hose placed thereon.

7. The drive device according to claim 3, characterised in that the carburettor comprises an injection nozzle and the recess is provided in alignment with the injection nozzle.

8. The drive device according to claim 7, characterised in that the recess tapers outwards from an opening extending along an inner circumference of the channel portion inner wall.

9. The drive device according to claim 8, characterised in that the recess tapers in a tetrahedral shape in a cross-section parallel to the normal of the channel portion inner wall.

10. The drive device according to claim 8, characterised in that the recess is formed in a crescent shape in a cross-section parallel to the normal of the channel portion inner wall.

11. The drive device according to claim 8, characterised in that the opening extends along the circumference of the channel portion inner wall and symmetrical to the alignment of the injection nozzle.

12. The drive device according to claim 11, characterised in that the opening extends along an angle of at least 20° along the inner circumference of the channel portion inner wall.

13. The drive device according to claim 12, characterised in that the angle is about 30°.

14. The drive device according to claim 1, characterised by cooling fins projecting outwards from the suction flange.

15. The drive device according to claim 1, characterised in that the removal device comprises a heat-conducting material.

16. The drive device according to claim 15, characterised in that the heat-conducting material comprises aluminum.

17. The drive device according to claim 1, characterised in that the internal-combustion engine comprises a four-stroke internal combustion engine.

18. A tool, in particular a motor-driven chainsaw with a drive device according to claim 1.

19. A drive device for a tool, comprising:

an internal combustion engine having a fuel-air mixture inlet and a carburettor with a fuel-air mixture outlet disposed in the direction of flow of a fuel-air mixture in front of the fuel-air mixture inlet;

a fuel-air mixture channel provided between the fuel-air mixture outlet and the fuel-air mixture inlet;

a lubricant guide along components to be lubricated; and a removal device for fuel with a recess which receives fuel and supplies the lubricant guide provided between the fuel-air mixture outlet and the fuel-air mixture inlet;

characterised in that:

the removal device comprises a channel portion inner wall in alignment with an inner wall of the fuel-air mixture channel;

the carburettor comprises an injection nozzle and the recess is provided in alignment with the injection nozzle; and the recess tapers outwards from an opening extending along an inner circumference of the channel portion inner wall.

20. The drive device according to claim 19, characterised in that the recess tapers in a tetrahedral shape in a cross-section parallel to the normal of the channel portion inner wall.

21. The drive device according to claim 19, characterised in that the recess is formed in a crescent shape in a cross-section parallel to the normal of the channel portion inner wall.

22. The drive device according to claim 19, characterised in that the opening extends along the circumference of the channel portion inner wall and symmetrical to the alignment of the injection nozzle.

23. The drive device according to claim 22, characterised in that the opening extends along an angle of at least 20° along the inner circumference of the channel portion inner wall.

24. The drive device according to claim 23, characterised in that the angle is about 30°.

* * * * *